US011073299B2

(12) United States Patent
Waldner et al.

(10) Patent No.: US 11,073,299 B2
(45) Date of Patent: Jul. 27, 2021

(54) VENTED FLOOR ARRANGEMENT AND A KIT OF PARTS FOR USE IN ASSEMBLING THE FLOOR

(71) Applicant: Better Air Manufacturing Ltd., MacGregor (CA)

(72) Inventors: John Waldner, MacGregor (CA); Daniel Waldner, MacGregor (CA)

(73) Assignee: Better Air Manufacturing Ltd., MacGregor (CA)

( * ) Notice: Subject to any disclaimer, the term of this patent is extended or adjusted under 35 U.S.C. 154(b) by 10 days.

(21) Appl. No.: 16/704,616

(22) Filed: Dec. 5, 2019

(65) Prior Publication Data

US 2020/0173684 A1 Jun. 4, 2020

Related U.S. Application Data

(63) Continuation-in-part of application No. 15/530,624, filed on Feb. 10, 2017, now Pat. No. 10,544,959.

(51) Int. Cl.
*F24F 13/02* (2006.01)
*F24F 7/04* (2006.01)
*E04B 5/48* (2006.01)

(52) U.S. Cl.
CPC ..... *F24F 13/0227* (2013.01); *F24F 7/04* (2013.01); *E04B 5/48* (2013.01)

(58) Field of Classification Search
CPC ..... F24F 13/06; F24F 13/0227; F24F 13/072; E04H 5/08; A01F 25/22; A01F 25/08
See application file for complete search history.

(56) References Cited

U.S. PATENT DOCUMENTS 770,326 A * 9/1904 Slater ..... F24F 13/06 454/290
3,985,158 A * 10/1976 Felter ..... F16L 9/12 138/149
5,451,081 A * 9/1995 Kaucnik ..... E02D 29/14 285/189
5,460,572 A * 10/1995 Waltz ..... E04B 1/7076 454/271
5,496,213 A * 3/1996 Miller ..... E04B 1/7076 249/39
5,713,172 A * 2/1998 Tegland ..... F24F 13/06 454/174
6,776,710 B1 * 8/2004 Messmer ..... F24F 13/06 34/97

* cited by examiner

*Primary Examiner* — Jessie T Fonseca
(74) *Attorney, Agent, or Firm* — Adrian D. Battison; Ade & Company Inc.; Ryan W. Dupuis

(57) ABSTRACT

A plug which fits into the top aperture of an air vent to be mounted on an air flow pipe or flume prevents cement flowing into the vent when a concrete floor is laid. The vent has a peripheral protrusion and a top flange. The plug protrusion snap fits into a in the top of the vent aperture and can be pulled out when the concrete is set. The plug has sides which extend upward an outward from the vent top so the laid concrete floor has a slot communicating with the vent and the vent top is installed below the floor and thus cannot be easily damaged by storing and removal of produce. The vent is inserted into a plate covering a flume where the plate has ribs and protrusions locating the required rebar and end tabs holding the plates end to end.

24 Claims, 7 Drawing Sheets

FIG. 11
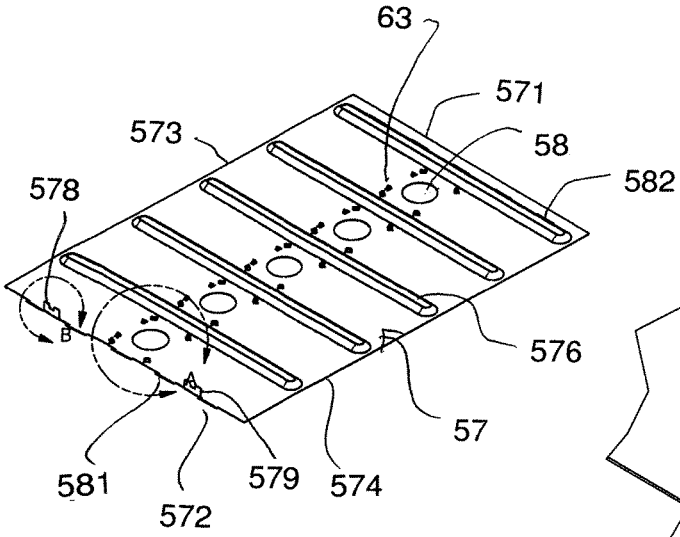
FIG. 12
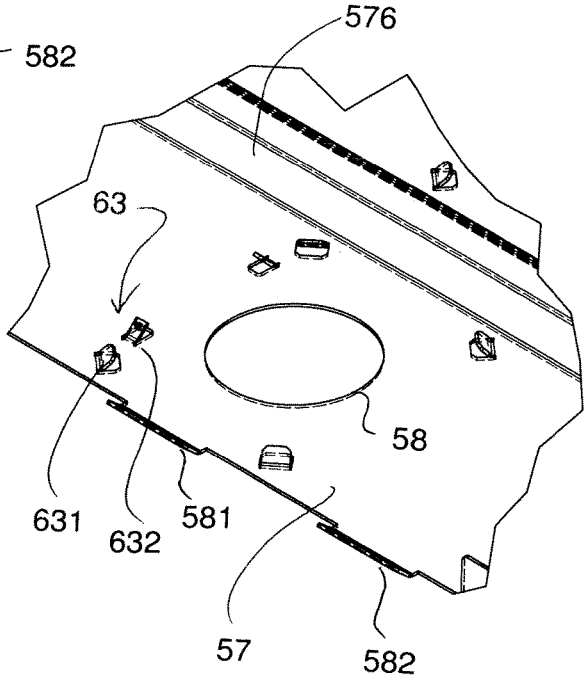
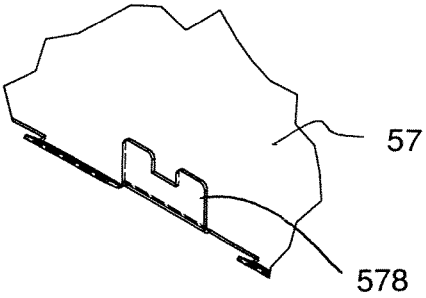
FIG. 13

VENTED FLOOR ARRANGEMENT AND A KIT OF PARTS FOR USE IN ASSEMBLING THE FLOOR

This application is a continuation in part of application Ser. No. 15/530,624 filed Feb. 10, 2017 now issued as U.S. Pat. No. 10,544,959.

This invention relates to a vented floor defined by a plurality of parallel aeration flumes or pipes arranged at spaced positions across the floor and a cast concrete layer over the flumes or pipes where the layer includes a plurality of floor vents cast into the concrete layer to define a slot shaped opening at the top and communicating with the flume or pipe at the bottom.

SUMMARY OF THE INVENTION

According to the invention there is provided a vented floor comprising: a plurality of parallel aeration flumes arranged at spaced positions across the floor;

each flume having a base and two upstanding side walls with an inwardly extending shoulder on each side wall at a position spaced from a top of the side wall;

and a vented cover on each aeration flume, the cover comprising:

a plurality of support plates arranged end to end and having a common width side of the plates between side edges of the plates so that the plates span across the flume and sit on the side shoulders of the flume along a length of the flume;

the support plates supporting a cast concrete floor on the plates in the flume to prevent entry during casting of cast concrete into the flume;

the plates having a plurality of holes along the plates at longitudinally spaced positions therealong and at positions spaced from the side edges;

a plurality of floor vents mounted on the support plates each in a respective hole in one of the plates;

each floor vent comprising a vent body defining a generally slot shaped top aperture arranged to extend in a direction across the plates and a bottom aperture to communicate through a respective hole in one of the plates to the flume;

said vent body being molded from a rigid plastic;

a plurality of plugs each arranged to be associated with a respective one of the floor vents;

each plug being formed of a flexible material and shaped so as to be at least partly inserted into the top aperture of the floor vent so as to close the top aperture to prevent entry of concrete during casting;

each plug being shaped so that after casting the plug can be pulled from the top aperture and the concrete to expose the top aperture to release air from the flume.

According to a second aspect of the invention there is provided a kit of parts for use in forming a vented cover on an aeration flume to create the vented floor. The kit comprises:

a plurality of support plates to be arranged end to end and having a common width side of the plates so that the plates can span across the flume and sit on side shoulders of the flume along a length of the flume;

the support plates being arranged to receive and support a concrete floor cast onto the plates in the flume to prevent entry of cast concrete into the flume;

the plates having a plurality of holes along the plates at longitudinally spaced positions therealong and at positions spaced from the;

a plurality of floor vents for mounting on the support plates each in a respective hole in one of the plates;

each floor vent comprising a vent body defining a generally slot shaped top aperture arranged to extend in a direction across the plates and a bottom aperture to communicate through a respective hole in one of the plates to the flume;

said vent body being molded from a rigid plastic;

a plurality of plugs each arranged to be associated with a respective one of the floor vents;

each plug being formed of a flexible material and shaped so as to be partly inserted into the top aperture of the floor vent so as to close the top aperture to prevent entry of concrete during casting;

each plug being shaped so that after casting the plug can be pulled from the top aperture and the concrete to expose the top aperture to release air from the flume.

In one preferred embodiment, each plug has a top surface standing proud of the top aperture when inserted therein. This can be located at the height of the top of the cast concrete so that the vent body itself is recessed.

In one preferred embodiment, each plug has along each side of the top aperture a surface extending upward and outward from the top aperture when inserted therein. This acts to flare the vent port in the concrete above the top edges of the vent body In one preferred embodiment, each floor vent comprises a lower internal recess or recesses at a position thereon spaced from the top aperture which receives one or more peripheral protrusions of the plug to hold the plug in place until removed after the casting. This can be in the form of a continuous bead along the side of the plug or as individual snap projections at spaced positions along the sides of the vent body.

In one preferred embodiment, each plate has a plurality of transversely extending longitudinally spaced ribs across the plate. Preferably the ribs terminate at a position spaced from the sides of the plate since this prevents the cast concrete from entering under the ribs at the sides. Preferably there is provided one of the ribs between each floor vent and the next. The ribs are arranged to support longitudinally extending rebars along the flume at positions spaced inwardly of the sides of the flume with the height of the ribs supporting the rebar at the correct height within the concrete.

In one preferred embodiment, the floor vents are formed in two molded halves and connected together to form a hollow interior.

In one preferred embodiment, the floor vents each have a neck adjacent the bottom aperture and a transverse flat wall projecting outwardly from the neck at a position on the neck raised upwardly from the bottom aperture where the transverse wall is arranged to sit on the plate with the neck below the plate projecting through the plate to the bottom aperture.

In one preferred embodiment, the transverse wall and the plate have cooperating elements which interconnect to allow the wall to be moved into a locking position in engagement with the plate and held in place thereon by the cooperating elements. Preferably the interconnecting elements require no tools to move to the locking position and in one arrangement the interconnecting elements move into the locking position by rotation of the floor vent around an axis at right angles to the plate. In this arrangement, the interconnecting elements can comprise tabs extending upwardly from the top surface of the plate.

In one preferred embodiment, the plate has a pair of transversely spaced upstanding tabs each with a recess at a top of the tab into which a longitudinally extending reinforcing bar is arranged to sit to locate the bar against side to side movement. This acts again to hold the rebars in the required location side to side and vertically in conjunction with the above ribs. Preferably the upstanding tabs are formed at one end of the plate by an upturned portion of the plate.

In one preferred embodiment, each plate has at one end a plurality of engagement tabs for engaging elements at an opposed end of a next adjacent plate to hold the plates end to end. The tabs can be provided by upstanding edge portions of the plate and engage into slots in the opposed end of the next adjacent plate.

In one preferred embodiment, a spacing between the plate and a top surface of the plug when inserted is equal to 3 inches since this is the height available in the conventional flume arrangement and is sufficient from the depth of the concrete provided there are no or few restrictions which interfere with the depth and strength of the concrete. The concrete may be of a reinforced type with additional fibers or other reinforcing systems.

According to another aspect of the present invention there is provided a vented floor or a kit of parts for forming the vented floor comprising: a plurality of parallel aeration flumes arranged at spaced positions across the floor;

each flume having a base and two upstanding side walls with an inwardly extending shoulder on each side wall at a position spaced from a top of the side wall;

and a vented cover on each aeration flume, the cover comprising:

a plurality of support plates arranged end to end and having a common width side of the plates between side edges of the plates so that the plates span across the flume and sit on the side shoulders of the flume along a length of the flume;

the support plates supporting a cast concrete floor on the plates in the flume to prevent entry during casting of cast concrete into the flume;

the plates having a plurality of holes along the plates at longitudinally spaced positions therealong and at positions spaced from the side edges;

a plurality of floor vents mounted on the support plates each in a respective hole in one of the plates;

each floor vent comprising a vent body defining a generally slot shaped top aperture arranged to extend in a direction across the plates and a bottom aperture to communicate through a respective hole in one of the plates to the flume;

wherein each plate has a plurality of transversely extending longitudinally spaced ribs across the plate which terminate at a position spaced from the side edges of the plate.

According to another aspect of the present invention there is provided a vented floor or a kit of parts for forming the vented floor comprising: a plurality of parallel aeration flumes arranged at spaced positions across the floor;

each flume having a base and two upstanding side walls with an inwardly extending shoulder on each side wall at a position spaced from a top of the side wall;

and a vented cover on each aeration flume, the cover comprising:

a plurality of support plates arranged end to end and having a common width side of the plates between side edges of the plates so that the plates span across the flume and sit on the side shoulders of the flume along a length of the flume;

the support plates supporting a cast concrete floor on the plates in the flume to prevent entry during casting of cast concrete into the flume;

the plates having a plurality of holes along the plates at longitudinally spaced positions therealong and at positions spaced from the side edges;

a plurality of floor vents mounted on the support plates each in a respective hole in one of the plates;

each floor vent comprising a vent body defining a generally slot shaped top aperture arranged to extend in a direction across the plates and a bottom aperture to communicate through a respective hole in one of the plates to the flume;

wherein the plate has a pair of transversely spaced upstanding tabs each with a recess at a top of the tab into which a longitudinally extending sits to locate the bar against side to side movement;

and wherein the plate has a plurality of transverse ribs having a top surface at a height thereon to support the longitudinally extending rebars at spaced positions along the plate.

According to another aspect of the present invention there is provided a vented floor or a kit of parts for forming the vented floor comprising:

a plurality of parallel aeration flumes arranged at spaced positions across the floor;

each flume having a base and two upstanding side walls with an inwardly extending shoulder on each side wall at a position spaced from a top of the side wall;

and a vented cover on each aeration flume, the cover comprising:

a plurality of support plates arranged end to end and having a common width side of the plates between side edges of the plates so that the plates span across the flume and sit on the side shoulders of the flume along a length of the flume;

the support plates supporting a cast concrete floor on the plates in the flume to prevent entry during casting of cast concrete into the flume;

the plates having a plurality of holes along the plates at longitudinally spaced positions therealong and at positions spaced from the side edges;

a plurality of floor vents mounted on the support plates each in a respective hole in one of the plates;

each floor vent comprising a vent body defining a generally slot shaped top aperture arranged to extend in a direction across the plates and a bottom aperture to communicate through a respective hole in one of the plates to the flume;

wherein the floor vents each have a neck adjacent the bottom aperture and a transverse flat wall projecting outwardly from the neck where the transverse wall sits on the plate;

and wherein the transverse wall and the plate have cooperating elements which interconnect to allow the wall to be moved into a locking position in engagement with the plate and held in place thereon by the cooperating elements.

In one broad aspect the invention is directed to a plug for a floor vent, the floor vent having a rectangular top aperture to communicate with the storage facility through a concrete floor, and; The plug comprises a body of flexible rubber like material, the body is rectangular having paired opposed parallel longitudinal side walls and paired opposed parallel transverse end walls connecting the longitudinal walls, and a side surface extending peripherally from the body This side surface extends upward and outward from the body at an angle to the side and end walls, and; the rectangular body of the plug is dimensioned to fit within the aperture of the air vent. Preferably the side walls and optionally the end walls comprise a lower peripheral convex protrusion, and this protrusion is adapted to engage an internal concave groove within the aperture of the air vent. More preferably the side surface extends upward and outward from the side walls and the end walls. Preferably the lower peripheral convex protrusion extends along the bottom of the side walls and end walls. However the interlocking may be effected by one or more interlocking tabs molded on the sides of the vent body and the plug. Preferably a plurality of cross walls connect the side walls at right angles to the side walls parallel to the end walls. Preferably a level connecting member connects the end walls the connecting member comprising threadlike members extending from end wall to end wall. More preferably a plurality of cross walls connect the side walls at right angles to the side walls parallel to the end walls, and the connecting members pass through the cross walls to resist pressure from the concrete and hold the mouth of the slot shaped aperture generally parallel.

In a second broad aspect the invention is directed to a floor vent for a storage facility comprising a slot shaped or rectangular top aperture to communicate with the storage facility through a concrete floor and a bottom circular aperture to communicate with a subfloor air duct system. The vent comprises rigid plastic. The top aperture comprises parallel spaced apart opposed longitudinal side walls connected by parallel spaced apart opposed transverse end walls. The longitudinal and transverse walls extend downward from the rectangular aperture to the bottom aperture, and the rectangular top aperture engages a plug to hold it in place during costing and allow it to be removed after the casting is complete. More preferably the top aperture comprises a lower internal concave groove, and the rectangular top aperture engages a plug, which has a protrusion which engages the internal concave groove. More preferably the rectangular aperture has a circumferential internal concave groove in the longitudinal and transverse walls and; the rectangular top aperture engages a plug which has a protrusion which engages the internal concave groove. Preferably the parallel spaced apart opposed longitudinal side walls of the vent incline outward and downward to merge into the cylindrical wall and, the parallel spaced apart opposed transverse end walls of the vent incline inward and downward to merge into the cylindrical wall and, the longitudinal and transverse walls remained connected until they merge into the cylindrical wall. Typically the cylindrical wall of the vent comprises a mounting flange or wall projecting outward from cylindrical wall to sit on a supporting structure such as a pipe or plate.

In a third broad aspect the invention is directed to a method of use of the vent and plug comprising the step of attaching the vent to a subfloor air duct system, and; the step of inserting the plug of into the top aperture of the vent so that it engages the aperture, and; the step of pouring concrete around the vent to the level of the flanges of the plug, and the step of allowing the poured concrete to cure, and; the step of removing the plug from the vent; whereby the vent is installed below the surface of the poured concrete.

BRIEF DESCRIPTION OF THE DRAWINGS

FIG. 11 is an isometric view of one plate for use in the embodiment of FIG. 8.

FIG. 12 is an enlarged view of one portion of the plate of FIG. 11 showing the mounting for the vent.

FIG. 13 is an enlarged view of one portion of the plate of FIG. 11 showing the support tab for the reinforcing bar.

DETAILED DESCRIPTION

Figure 1:
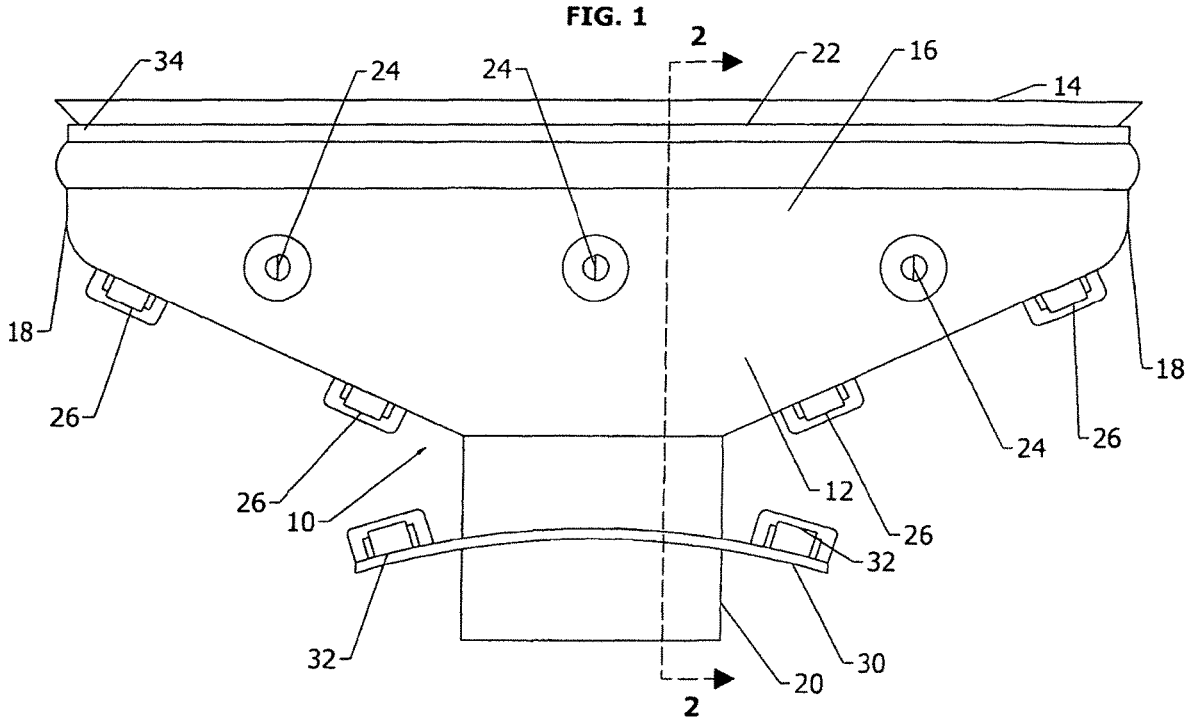
FIG. 1 shows a side view of floor vent and associated plug according to an embodiment of the invention for use in forming the floor.
Figure 2:
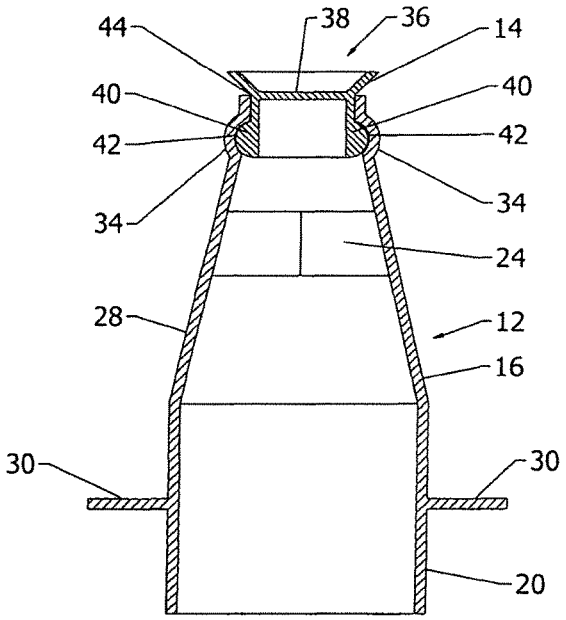
FIG. 2 shows a transverse cross-sectional view of the vent and plug of FIG. 1.
Figure 3:
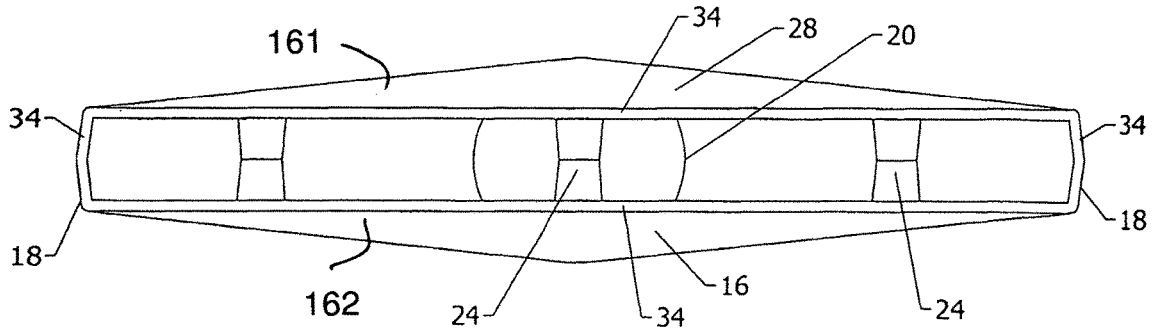
FIG. 3 shows a top view of the vent of FIG. 1 without its associated plug.

The invention is illustrated by reference to the preferred embodiment. Numeral 10 indicates the floor inlet assembly of the invention, which comprises vent 12 and plug 14, vent 12 has front surface 16, end surfaces 18 and cylindrical bottom duct 20. End surfaces 18 incline inward as shown forming an arc of a circle to smoothly merge into cylindrical duct 20 similarly front surface 16 inclines outward to smoothly merge into cylindrical duct 20 as does rear surface 28. Support pillars 24 joining front surface 16 to rear surface 28, prevent the floor inlet collapsing when concrete is pored around it. Support pillars 24 interlock, or friction fit together. Fasteners 26 similarly join front surface 16 to rear surface 28. Mounting flange 30, which is used to attach inlet 10 to a hole in a cylindrical ventilation pipe, not shown, is similarly joined by fasteners 32. Vent 12 has top peripheral protrusion 34 convex externally, concave internally surrounding slot 36, which matingly receives the plug 14.

Figure 4:
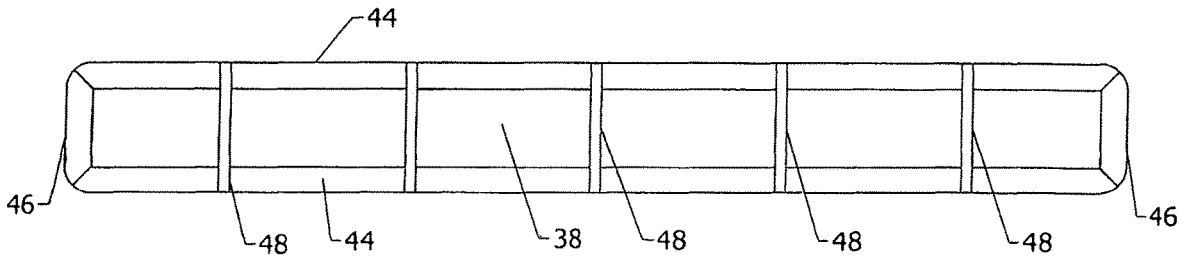
FIG. 4 shows a top plan view of the plug of the embodiment of FIG. 1
Figure 5:
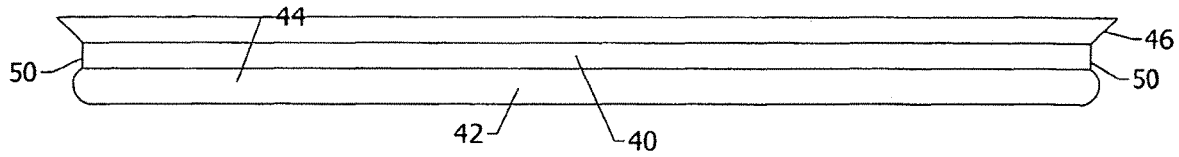
FIG. 5 shows a side view of the plug of the embodiment of FIG. 1.
Figure 6:
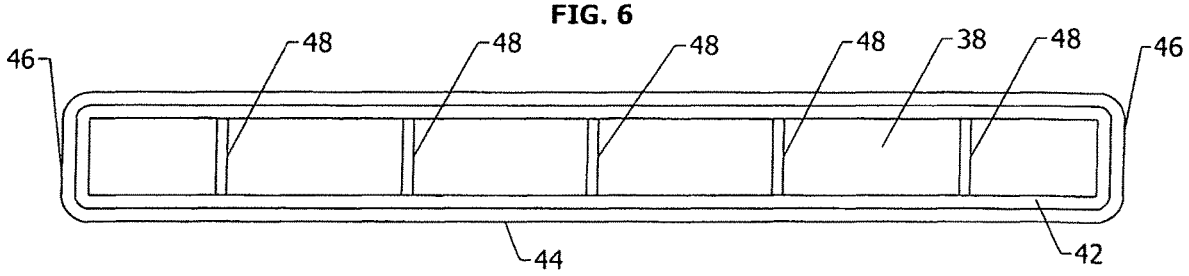
FIG. 6 shows a bottom view of the plug of the embodiment of FIG. 1

Plug 14 has side walls 40, which have peripheral convex protrusion 42 which engages the concave interior of protrusion 30. Plug 14 has level connecting wall 38 and outward inclined side surfaces 44 and end surfaces 46. Outward inclined surfaces 44 and 46 extend upward from the top of slot 36 about ¼ inch (6% mm) and outward about the same distance so that the angle is about 45 degrees. These side surfaces can be formed as flanges as shown which are about 1/16 inch (11/2 mm) thick. Alternatively the plug at the top can be flat so that the side surfaces 44 and 46 are sides of the body. As shown in FIG. 4, several cross walls 48 connect the flanges 44 above level connecting wall 38 to provide stiffness. Alternatively the level connecting wall can form a top surface of the plug thus avoiding the necessity for the stiffening walls 48, Cross walls 48 are about 1/16 inch (11/2 mm) thick, level connecting wall 34 is composed of parallel threads extending along the length of the plug, typically about 1/16 or 1/32 inch thick (11/2 or ¾ mm), in use this allows small stones from the cement to fall down through the inlet opening 36. Plug sidewalls 40 are also about 1/16 inch (11/2 mm) thick as are end walls 50. Side walls 40 and end walls 50 extend downward about ⅜ inch (1 cm) the bottom portion of which is protrusion 42, which is convex extending about 5/16 inch (3/4 cm) downward and is about 3/16 inch (1/2 cm) thick at maximum. As shown in FIG. 6 cross walls 44 also connect side walls 40 below cross wall 38, while flanges 44 and 46 project marginally beyond protrusion 34. The number of cross walls 44 is not critical and one or more may be optionally doubled separating plug 14 into two or more sections, however a unitary plug is preferred.

The arrangement shown and described above is particularly for use with an arrangement of vented floor where the air flow is provided in a plurality of parallel pipes laid across the floor and connected to a supply of air. The vents are then mounted on the pipes at longitudinally spaced positions with the top slot shaped mouth across the pipe and the lower end projecting through a hole in the pipe to receive the air. When a layer of concrete is cast over the pipes, the vent is plugged with the flexible plug and the concrete poured to a level matching the top of the plug. The plug is then removed after the pour is set so that the plug molds a slot in the concrete above the vent so that the slot in the concrete is higher than the top of the vent and is wider than the top of the vent. In this way the plastic vent is kept away from blades sliding over the concrete surface to avoid damage to the vent body or tearing of the body from the concrete.

Turning now to FIGS. 8 to 13, there is shown an alternative arrangement using basically the same vent and plug but in relation to a different form of air conduit.

Thus the floor comprises a plurality of parallel aeration flumes 500 arranged at spaced positions across the floor 51. Each flume 500 has a base 52 and two upstanding side walls 53, 54 with an inwardly extending shoulder 55 on each side wall at a position spaced from a top 56 of the side wall.

In many cases the flume is an existing arrangement in the floor and is covered in an initial state by a row of 3 inch planks across the shoulders leaving vent openings between the planks. However this is not an acceptable construction and it is preferred that this be replaced with a layer of concrete so that the whole floor is formed by concrete allowing heavy moving equipment to move across the floor without potential damage. Thus the construction includes a vented cover of a layer of concrete on each aeration flume.

The cover comprises a plurality of support plates 57 arranged end to end at transvers ends 571 and 572 and having a common width of the plates between side edges 573 and 574 of the plates so that the plates 57 span across the flume 500 and sit on the side shoulders 55 of the flume along the length of the flume. In the completed construction, the support plates 57 support a cast concrete floor 575 on the plates in the flume. The layer has a thickness equal to the depth of the shoulder so that the top surface of the concrete layer on the flume is equal to the height of the top 56 of the sides of the flume to form a flat surface at the flumes and between the flumes.

The plates 57 are shaped and arranged to prevent entry during casting of cast concrete into the flume so that the pouring of the casting material is simply applied onto the plates.

In order to mount the vents 12, the plates have a plurality of holes 58 along the plates at longitudinally spaced positions along a midline of the plate so as to be located at positions spaced from the side edges. Thus when assembled there is provided on each plate a plurality of floor vents 12 mounted on the support plates each in a respective hole in one of the plates As described above, each floor vent comprising a vent body 16 molded in two halves 161 and 162 from a rigid plastics material and defining the generally slot shaped top aperture 163 defined between the side walls and arranged to extend in a direction across the plates 57 and thus across the flume. The circular bottom aperture so includes a neck 201 adjacent the bottom aperture 202 and a transverse flat wall 203 projecting outwardly from the neck 201 at a position on the neck raised upwardly from the bottom aperture 202 where the transverse wall 203 is arranged to sit on the plate 57 with the neck 201 below the plate projecting through the plate to the bottom aperture 202 to communicate to the flume;

Each vent cooperates with a respective one of the plurality of plugs 14, each plug formed of a flexible material and shaped so as to be at least partly inserted into the top aperture of the floor vent so as to close the top aperture to prevent entry of concrete during casting and being shaped so that after casting the plug can be pulled from the top aperture and the concrete to expose the top aperture to release air from the flume. The plug has suitable mounting portions which hold it in place during casting and this can be formed by a bead 141 along the side edge as shown on the left of FIG. 7 or by a plurality of separate projections 142 as shown on the right. The vent body is formed similarly with receptacles to receive the cooperating part from the plug. The design of the cooperating fastening can use many different arrangements provided they meet the requirement of easy insertion and removal and the necessary connection to remain in place during the casting process.

Figure 7:
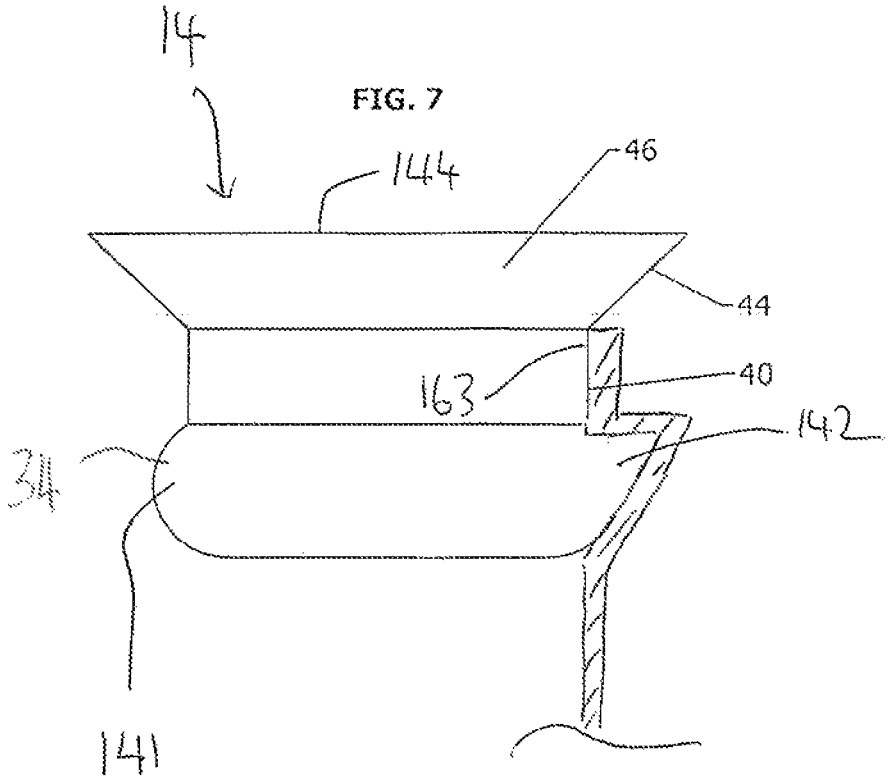
FIG. 7 shows an end view of the plug of the embodiment of FIG. 1 also modified to show an alternative arrangement in which the elongate bead along the side of the plug for locking into the vent is replaced by a plurality of space snap projections.

Also as shown in FIG. 7, each plug 14 has a flat top surface 144 standing proud of the top aperture when inserted therein so as to define the outwardly inclined side surfaces 44. In the finished construction shown in FIG. 10, this forms side surfaces 441 and 442 in the concrete which stand up from the top aperture 163 to hold any passing blades of heavy lifting equipment away from the vent body to slide over the concrete surface. The flared mouth so formed in the concrete avoids a sharp edge at the junction between the mouth and the concrete surface to reduce cracking and chipping.

Each plate has a plurality of transversely extending longitudinally spaced ribs 576 across the plate. As shown in FIG. 11, the ribs 576 terminate at an end position 577 spaced from the sides 573, 574 of the plate 57. This means that the plate when viewed from above has no aperture at the end of the ribs which would otherwise allow the cast material to enter into the area adjacent the shoulders and into the flume. The end of the rib thus sits on the shoulder to stiffen the late between the shoulders and provide sufficient strength to accommodate the load from the cast material. There is provided one of the ribs between each floor vent or hole 58 for the floor vent and the next so that the holes 58 and the ribs 576 are arranged alternately along the plate.

Figure 8:
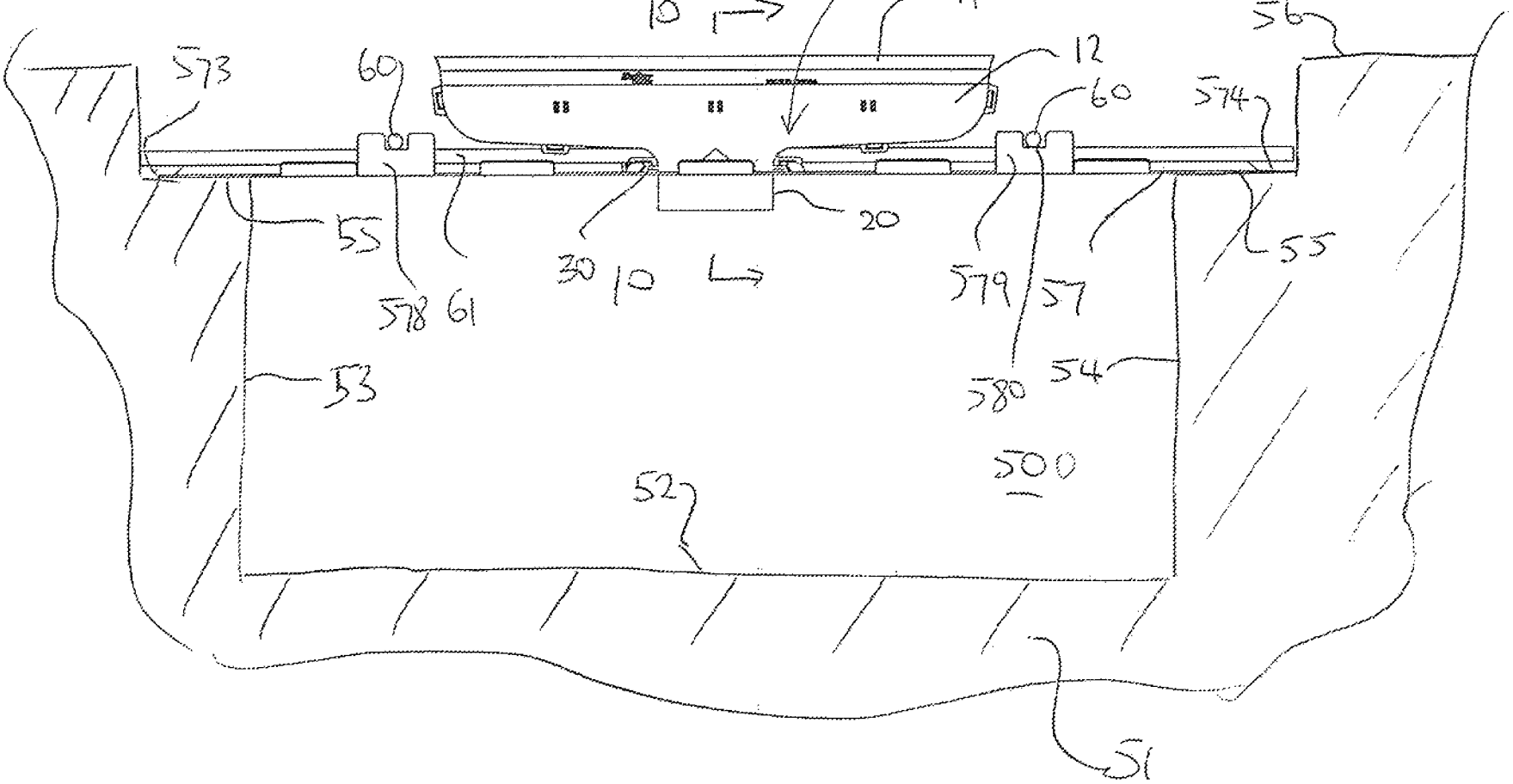
FIG. 8 is a transverse cross-sectional view through a second embodiment of vented floor where the vent and plug of FIG. 1 are used by mounting on a plate which bridges a rectangular flume or pipe for receiving a layer of concrete covering the flume and embedding the vent.
Figure 9:
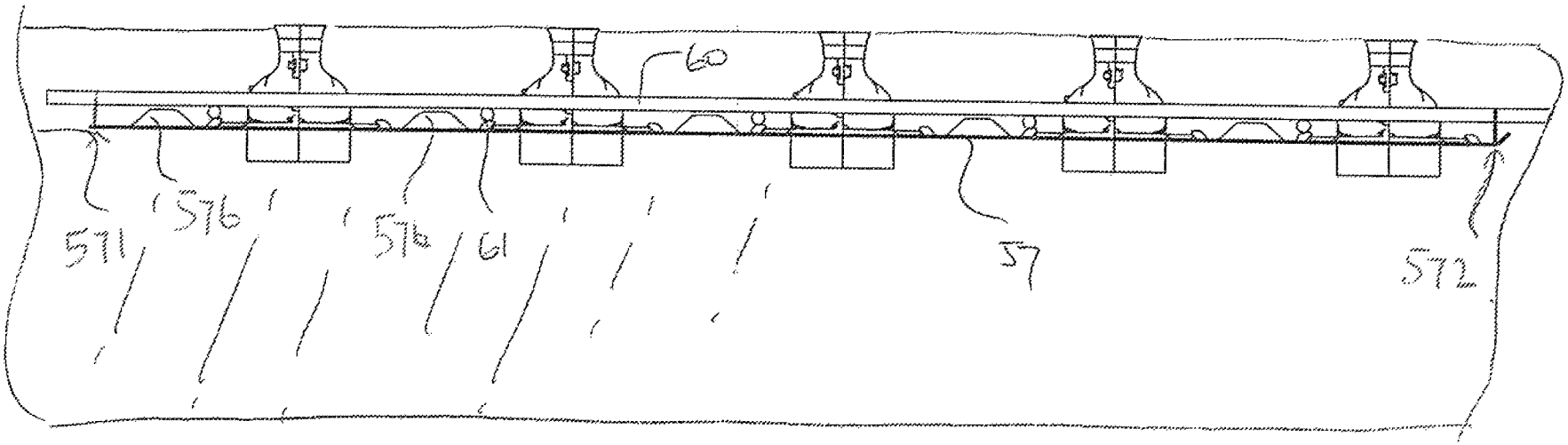
FIG. 9 is a longitudinal cross-sectional view through the second embodiment of FIG. 8.
Figure 10:
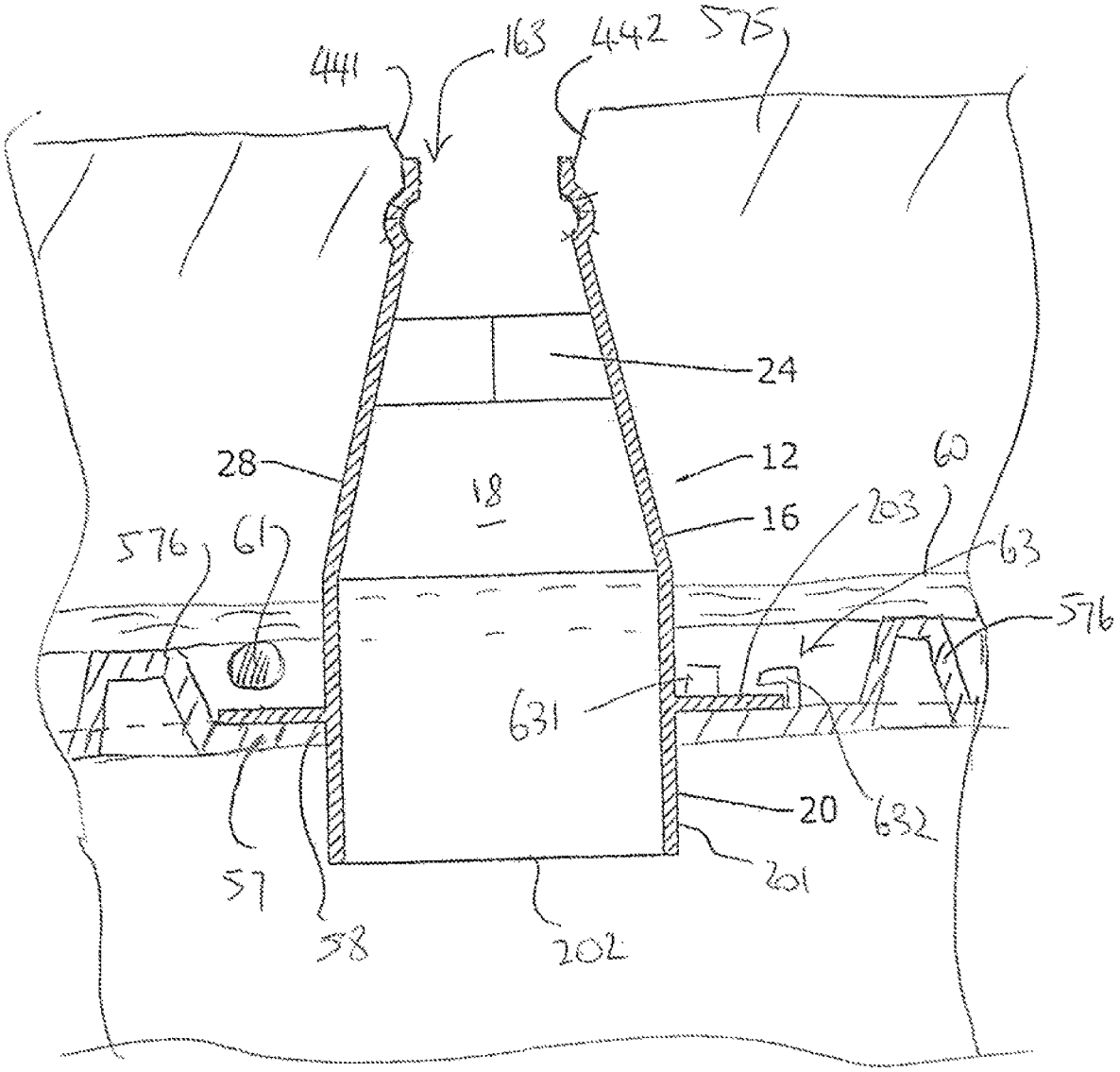
FIG. 10 is a cross-sectional view along the lines 10-10 of FIG. 8.

In order to provide structural strength for the concrete layer, there are provided longitudinal rebars 60 and transverse rebars 61. The former extend along the flume typically as a single length or as pieces along the full length of the flume. The latter are tied to the former underneath the former and span across the with of the flume to be located on top of the shoulders. The ribs 576 are arranged at a height so that each acts to support longitudinally extending rebars at positions along the flume and at positions spaced inwardly of the sides 53, 54 of the flume as best shown in FIG. 8.

The transverse wall 203 and the plate 57 have cooperating elements 63 which interconnect to allow the wall 203 to be moved into a locking position in engagement with the plate and held in place thereon by the cooperating elements without the use of tools to move to the locking position. That is there are table 631 and 632 on the plate which are located relative to components on the wall 203 so that a movement of the wall from an initial position to a locked position moves the wall into engagement with the tabs to hold the wall against the plate sufficiently to accommodate the pour. As the neck 201 in the hole 58 restricts the wall to rotation, typically the interconnecting elements move into the locking position by rotation of the floor vent around an axis at right angles to the plate. However it will be appreciated that other designs and layout of the table may allow this movement simply and without tools into a locked position.

In order to easily locate the longitudinal rebars 60 sitting on the top surface of the ribs 576, the plate 57 has at one end edge a pair of transversely spaced upstanding tabs 578 and 579 formed by bending upwardly and end portion of the plate. Each tab has a recess 580 at a top of the tab into which the longitudinally extending reinforcing bar 60 is arranged to sit to locate the bar against side to side movement. It will be appreciated that each plate has one set of tabs at one end so in an arrangement where the plates have a length of the order of 4 feet the rebars can be easily applied into place as the vertical positioning is provided by the ribs and the side to side positioning is provided by the tabs.

In order to help locate the plates end to end, each plate has at one end a plurality of engagement tabs 581 for engaging slots or other elements 582 at an opposed end of a next adjacent plate to hold the plates end to end. The tabs are inclined beyond the adjacent end of the plate upwardly and outwardly so that a slight overlap of the plates brings the tabs into engagement with a matching number of slots to allow each plate to be dropped into an engagement with the next with no risk of unacceptable spaces therebetween.

The invention claimed is:

1. A vented floor comprising:

a plurality of parallel aeration ducts arranged at spaced positions across, the floor;

and a vented cast concrete cover on the ducts, the cover comprising:

a plurality of floor vents mounted on the ducts each in a respective hole in a respective one of the ducts;

each floor vent comprising a vent body defining top aperture slot with sides which extend in a direction across the respective duct and a bottom aperture which communicates through a respective hole in one of the ducts;

said vent body being molded from a rigid plastic;

a plurality of plugs each inserted in the top aperture slot of a respective one of the floor vents so as to close the top aperture slot to prevent entry of concrete during casting;

each plug being formed of a flexible material;

each plug being shaped so that after casting the plug can be pulled from the respective top aperture slot and the concrete to expose each top aperture slot to release air from the respective duct;

wherein each plug has a top surface raised from a top edge of the top aperture slot;

and herein each plug has along each side of the top edge of the respective top aperture slot a surface extending upward and outward from the top edge of the respective top aperture slot to the top surface.

2. The vented floor according to claim 1 wherein each duct comprises a flume having a base and two upstanding side walls with a shoulder along each respective side wall at a position spaced from a top of the respective side wall and a plurality of support plates arranged end to end and having a common width of the support plates between side edges of the support plates so that the support plates span, across the flume and sit on the shoulders of the flume along a length of the flume.

3. The vented floor according to claim 2 wherein each support plate has a plurality of transversely extending longitudinally spaced ribs across the support plate.

4. The vented floor according to claim 3 wherein the ribs terminate at a position spaced from sides of the respective support plate.

5. The vented floor according to claim 3 wherein there is provided one of said ribs between each floor vent and an adjacent floor vent of the plurality of floor vents.

6. The vented floor according to claim 3 wherein the ribs support longitudinally extending rebars along the respective flume at positions spaced inwardly of the sides walls of the respective flume.

7. The vented floor according to claim 2 wherein each support plate has a pair of transversely spaced upstanding tabs each with a recess at a top of each of the tabs into which a longitudinally extending reinforcing bar sits to locate the longitudinally extending reinforcing bar against side to side movement.

8. The vented floor according to claim 7 wherein the each support plate has a plurality of transverse ribs having a top surface at a height thereon to support the longitudinally extending reinforcing bars at spaced positions along the support plate.

9. The vented floor according to claim 2 each support plate has at one end a plurality of engagement tabs for engaging elements at an opposed end of a next adjacent support plate to of the plurality of support plates hold the support plates end to end.

10. The vented floor according to claim 2 wherein a spacing between each support plate and the top surfaces of the plugs is equal to 3 inches.

11. The vented floor according to claim 1 wherein each said floor vent comprises a lower internal concave groove at a position thereon spaced from the top edge of the respective top aperture slot which receives a peripheral protrusion of the respective one of the plugs to hold the respective one of the plugs in place until removed after the casting.

12. The vented floor according to claim 1 wherein each of the floor vents has a neck adjacent the bottom aperture and a transverse flat wall projecting outwardly from the neck at a position on the neck raised upwardly from the bottom aperture where the transverse wall is arranged to sit on the respective one of the ducts with the neck below the duct projecting through the respective one of the holes and wherein the transverse wall and the respective one of the ducts have cooperating elements which interconnect to allow the transverse wall to be moved into a locking position in engagement with the respective one of the ducts and held in place thereon by the cooperating elements.

13. The vented floor according to claim 12 wherein the interconnecting elements require no tools to move to the locking position.

14. The vented floor according to claim 12 wherein the interconnecting elements move into the locking position by rotation of each floor vent around an axis at right angles to the respective one of the ducts.

15. The vented floor according to claim 12 wherein the interconnecting elements comprise tabs extending upwardly from a top surface of the respective one of the ducts.

16. A vented floor comprising:

a plurality of aeration flumes arranged at parallel spaced positions across the floor;

each aeration flume having a base and two upstanding side walls with a shoulder along each respective side wall at a position spaced from a top of the respective side wall;

and a vented cover on each aeration flume, the vented cover comprising:

a plurality of support plates arranged end to end and having a common width of the support plates between side edges of the support plates so that the support plates span across the aeration flume and sit on the side shoulders of the aeration flume along a length of the aeration flume;

the support plates supporting a cast concrete floor on the support plates in, the aeration flume to prevent entry during casting of cast concrete into the aeration Hume;

the support plates having a plurality of holes along the support plates at longitudinally spaced positions therealong and at positions spaced from the side edges;

a plurality of floor vents mounted on the support plates each in a respective hole in a respective one of the support plates;

each floor vent comprising a vent body defining a top aperture slot with sides which extend in a direction across the support plates and a bottom aperture to communicate through a respective hole in a respective one of the support plates to a respective one of the aeration flumes;

wherein each support plate has a plurality of transversely extending longitudinally spaced ribs across the support plate which terminate at a position spaced from the side edges of the support plate.

17. The vented floor according to claim 16 wherein the ribs terminate at a position spaced from sides of the respective support plate.

18. The vented floor according to claim 17 wherein there is provided one of said ribs between each floor vent and an adjacent floor vent of the plurality of floor vents.

19. The vented floor according to claim 17 wherein the ribs support longitudinally extending rebars along the respective aeration flume at positions spaced inwardly of the side walls of the respective aeration flume.

20. A vented floor comprising:

a plurality of aeration flumes arranged at parallel spaced positions across the floor;

each aeration flume having a base and two upstanding side walls with a shoulder along each respective side wall at a position spaced from a top of the respective side wall;

and a vented cover on each aeration flume, the vented cover comprising:

a plurality of support plates arranged end to end and having a common width of the support plates between side edges of the support plates so that the support plates span across the aeration flume and sit on the side shoulders of the aeration flume along a length of the aeration flume;

the support plates supporting a cast concrete floor on the support plates in the aeration flume to prevent entry during casting of cast concrete into the aeration flume;

the support plates having a plurality of holes along the support plates, at longitudinally spaced positions therealong and at positions spaced from the side edges;

a plurality of floor vents mounted on the support plates each in a respective hole in respective one of the support plates;

each floor vent comprising a vent body defining a top aperture slot with sides which extend in a direction across the support plates and a bottom aperture to communicate through a respective hole in a respective one of the support plates to a respective one of the aeration flumes;

wherein each support plate has a pair of transversely spaced upstanding tabs each with a recess at a top of each of the tabs into which a longitudinally extending reinforcing bar sits to locate the longitudinally extending reinforcing bar against side to side movement;

and wherein each support plate has a plurality of transverse ribs having a top surface of a height thereon to support the longitudinally extending reinforcing bars at spaced positions along the support plate.

21. A vented floor comprising:

a plurality of aeration flumes arranged at parallel spaced positions across the floor;

each aeration flume having a base and two upstanding side walls with shoulder along each respective side wall at a position spaced from a top of the respective side wall;

and a vented cover on each aeration flume, the vented cover comprising:

a plurality of support plates arranged end to end and having a common width of the support plates between side edges of the support plates so that the support plates span across the aeration flume and sit on the side shoulders of the aeration flume along a length of the aeration flume;

the support plates supporting a cast concrete floor on the support plates in the aeration flume to prevent entry during casting of cast concrete into the aeration flume;

the support plates having a plurality of holes along the support plates at longitudinally spaced positions therealong and at positions spaced from the side edges;

a plurality of floor vents mounted on the support plates each in a respective hole in a respective one of the support plates;

each floor vent comprising a vent body defining a top aperture slot with sides which extend in a direction across the support plates and a bottom aperture to communicate through a respective hole in a respective one of the support plates to a respective one of the aeration flumes;

wherein each of the floor vents has a neck adjacent the bottom aperture and a transverse wall projecting outwardly from the neck where the transverse wall sits on a respective one of the plates;

and wherein the transverse wall and the respective one f the support plates have cooperating elements which interconnect to allow the wall to be moved into a locking position in engagement with the respective one of the support plates and held in place thereon by the cooperating elements.

22. The vented floor according to claim 21 wherein the interconnecting elements move into the locking position by rotation of each floor vent around an axis at right angles to the respective one of the ducts.

23. The vented floor according to claim 21 wherein the interconnecting elements comprise tabs extending upwardly from a top surface of the respective one of the ducts.

24. A vented floor comprising:

a plurality of parallel aeration ducts arranged at spaced positions across the floor;

and a vented cast concrete cover on the ducts, the cover comprising:

a plurality of floor vents mounted on the ducts each in a respective hole in one of the ducts;

each floor vent comprising a vent body defining a top aperture slot with sides which extend in a direction across the respective duct and a bottom aperture which communicates through a respective hole in one of the ducts;

said vent body being molded from a rigid plastic;

a plurality of plugs each inserted in the top aperture slot of a respective one of the floor vents so as to close the top aperture slot to prevent entry of concrete during casting;

each plug being formed of a flexible material;

each plug being shaped so that after casting the plug can be pulled from the respective top aperture slot and the concrete to expose each top aperture slot to release air from the respective duct;

wherein each said floor vent comprises a lower internal concave groove at a position thereon spaced from, the top edge of the respective top aperture slot which receives a peripheral protrusion of the respective one of the plugs to hold the respective one of the plugs in place until removed after the casting.

* * * * *